US005222712A

United States Patent [19]

Gregory

[11] Patent Number: 5,222,712

[45] Date of Patent: Jun. 29, 1993

[54] REMOVABLY MOUNTED CHAIR AND APPARATUS FOR REMOVING IT

[76] Inventor: Donald J. Gregory, 19704 Hiawatha Rd., Odessa, Fla. 33556

[21] Appl. No.: 925,129

[22] Filed: Aug. 6, 1992

Related U.S. Application Data

[63] Continuation-in-part of Ser. No. 769,461, filed Oct. 1, 1991.

[51] Int. Cl.[5] ..... A47B 97/00

[52] U.S. Cl. ..... 248/544; 248/503.1; 248/506

[58] Field of Search ..... 248/500-503, 248/503.1, 506, 154, 680, 544, 551; 296/65.1; 297/15

[56] References Cited

U.S. PATENT DOCUMENTS

| | | | |
|---|---|---|---|
| 3,419,164 | 12/1968 | O'Neill | 296/65.1 X |
| 4,241,893 | 12/1980 | Koutsky et al. | 296/65.1 X |
| 4,789,126 | 12/1988 | Rice et al. | 248/503.1 |
| 4,971,379 | 11/1990 | Rumpel et al. | 248/503.1 X |
| 5,125,711 | 6/1992 | Syed et al. | 248/503.1 X |

FOREIGN PATENT DOCUMENTS

| | | | |
|---|---|---|---|
| 1079959 | 12/1954 | France | 248/506 |

*Primary Examiner*—Alvin C. Chin-Shue
*Attorney, Agent, or Firm*—Stanley M. Miller

[57] ABSTRACT

A chair is removably mounted to the floor of a theater or other assembly hall so that it may be quickly removed when needed to provide space for a patron using a wheelchair and quickly reinstalled afterwards. Holes are formed in the floor of the theater, in a generally square pattern, and plugs are positioned in each hole. A baseplate upon which the chair is permanently mounted has plug-engaging members depending from its underside. The forward plug-engaging members slidingly engage the forward plugs, and the rearward plug-engaging members are biased to latchingly engage the rearward plugs. A special tool is inserted through access holes in the base plate to overcome the bias and disengage the rearward plug-engaging members. The tool includes a pair of wheels joined by an axle so that when the rearward end of the chair is tilted forwardly after disengagement of the rearward plug-engaging members and the rearward plugs, the tool is inverted and inserted through a different pair of holes in the base plate to form a dolly that enables the chair to be carted away. No tools are needed to reinstall the chair.

18 Claims, 9 Drawing Sheets

REMOVABLY MOUNTED CHAIR AND APPARATUS FOR REMOVING IT

CROSS-REFERENCE TO RELATED APPLICATIONS

This disclosure is a continuation-in-part of a copending disclosure of the same title by the same inventor, bearing Ser. No. 07/769,461, filed Oct. 1, 1991.

BACKGROUND OF THE INVENTION

1. Field of the Invention

This invention relates, generally, to removably mounted chairs or other objects. In one embodiment, it relates to a theater chair and a device that removes the chair as needed to accommodate wheelchairs.

2. Description of the Prior Art

People who use wheelchairs are often denied access to movie theaters or other theaters of the performing arts because the premises are not designed to accommodate wheelchairs. In a typical house of the performing arts, or other assembly halls, all available space is occupied by permanently mounted seats. Fire codes do not allow the blocking of aisles by wheelchairs; accordingly, if a person in a wheelchair is unable or unwilling to be removed from the wheelchair and deposited into a seat, that person is unable to see the movie or other performance.

Laws have been enacted in some states that require assembly hall or theater operators to make the facilities accessible by those in wheelchairs. Most owners of such establishments have responded by removing several seats in the back row of seats so that wheelchair patrons can use the space thereby made available. Obviously, if more than one patron in a wheelchair desires to see a show, attend a speech, or the like, only the first to arrive or make reservations may be served. Moreover, a movie or other performance will sometimes play to a sellout crowd, and the space reserved for a wheelchair is unused. The owner of the establishment thus loses revenue and is even more reluctant to remove further seats to accommodate more than one wheelchair.

Thus, there is a problem in the theater industry and wherever permanently mounted seats are found, but the industry has heretofore been unable to develop a solution thereto.

There are also many items other than chairs that need to be securely mounted to a floor or other support surface, yet movable from time to time. For example, coin-operated vending machines, computers in arcades dedicated to game playing, tables in public parks and restaurants, bus seats, and many other items too numerous to mention often require secure mounting, but their utility would be enhanced if they could be removably mounted so that they could be moved by authorized personnel whenever needed.

The teachings and suggestions of the prior art provide no insight as to how chairs and numerous other items could be securely mounted yet removable as needed. Importantly, any acceptable means for removing the item would have to require a special tool so that vandals, pranksters, or thieves could not move such items at will. Just as importantly, the structure which holds down the item should not be visible to the casual observer so that even if a tool capable of removing the item were to fall into the possession of a thief or other unauthorized person, the method of removal of the item with the tool would not be apparent.

The prior art neither teaches nor suggests how such a removable mounting could be accomplished. It follows that the art also does not teach or suggest how a special tool could be provided to accomplish the removal procedure, or how the method of use of the tool could be concealed from unauthorized personnel.

SUMMARY OF THE INVENTION

The invention arises from the insight that the solution to the problem relating to the absence of wheelchair space in public halls resides in the provision of a removably mounted chair. From this initial insight flows the solution to the problem relating to secure yet removable mounts for vending machines and the like.

When no wheelchair-using patrons appear at a show, all of the seats may be filled without a loss of revenue to the owner of the establishment. If one wheelchair-using patron attends the performance, the required number of the novel removable chairs can be removed to accommodate the wheelchair; if two wheelchair-using patrons attend, more chairs can be removed to accommodate the two wheelchairs, and so on. Thus, the establishment is flexible and can adapt to the needs of its patrons as the needs are presented.

The novel chair, advantageously, is designed so that it is easily removed by an employee of the theater, but is not removable by a patron. This is accomplished by mounting the chair such that a special tool is required detach it. The same tool may be employed to return a removed chair to its regular position, but no tool is needed to accomplish the actual reinstallation.

The conventional chair is first removed and four holes are formed in the floor in a generally square, rectangular array; a plug that performs the function of a catch member is then placed into each hole, and a flat base plate is placed into overlying relation to the floor and the plugs. The removable chair, sold under the trademark Bye Chair, is permanently mounted to the base plate.

More particularly, the base plate includes a longitudinally aligned, flat left foot plate and a longitudinally aligned, flat right foot plate that are interconnected by a transversely disposed flat interconnecting plate. A rigid left foot pin depends from the forward end of the left foot plate and a rigid right foot pin depends from the forward end of the right foot plate. Each foot pin enters into a keyway formed in its associated forward plug and is retained therein. A left rotation block assembly depends from the rearward end of the left foot plate and a right rotation block assembly depends from the rearward end of the right foot plate. Each rotation block assembly enters into an opening formed in its associated rear floor plug and includes a biased rotation pin that engages the strike bar disposed horizontally within each rear floor plug. Specifically, as the base plate is lowered into position, the forward left and right foot pins are inserted into their respective keyways and slid forwardly into their retained positions; the rear rotation block assemblies are then lowered into their respective plugs. The pivotally mounted, biased rotation pin is driven out of its position of repose by the immovable strike bar until continued lowering of the rearward end of the base plate allows the rotation pin to pass the strike bar; the bias means then returns said rotation pin to its position of repose, and said rotation pin engages the strike bar. This holds the rearward end of the base plate down until a tool is used to drive the rotation pin out of its position of repose again so that said rotation pin can be lifted past the strike bar. After the rearward end of the chair has been lifted, then the forward end can be slid rearwardly to allow disengagement of the forward foot pins from their associated front plugs.

The tool required to overcome the bias means that holds each rotation pin to its associated strike bar also includes wheels so that the chair can be rolled away after the base plate has been detached from the plugs in the floor of the establishment and so that a previously removed chair can be returned easily to its regular position. The wheels are interconnected by an axle member having a length about equal to the breadth of the base plate. A left removal pin depends from the left end of the axle, inwardly of the left wheel, and a right removal pin depends from the right end of the axle, inwardly of the right wheel. The pins are placed in holes formed in the left and right ends of the base plate, respectively; as the pins are driven downwardly, they encounter their associated biased rotation pin and drive it out of latching engagement with its strike bar. Each removal pin becomes sandwiched between the biased rotation pin member and the pin about which it is pivotally mounted. The bias on each rotation pin causes each removal pin to be tightly sandwiched between said rotation pin and the pivot axle of the rotation pin; thus, as the employee of the establishment lifts the rearward end of the chair, the rearward end of the base plate and the left and right rotation block assemblies depending from the left and right ends therefrom, respectively, are removed from their associated left and right rear floor plugs. This enables the front end of the base plate to be slid rearwardly to disengage the left and right forward foot pins from their associated plugs and the chair is accordingly detached. Advantageously, the removal pins are then slid out of the entrance holes formed in the base plate, and the tool is inverted so that the removal pins may be inserted through a second set of holes in the base plate so that the wheels may be used to support the chair during its transportation to another site. The employee merely tilts the released chair back until a stable balance thereof is found, and pushes the chair as if it were a dolly or hand truck, using the chair back as the handle of the dolly. The same technique is used to return the chair to its regular position after the space is no longer needed for wheelchairs.

Another tool for positioning the plugs in a concrete floor at the time the floor is poured is also provided. This tool has utility during the construction phase of a movie theater or other assembly hall; it includes a frame for holding four plug engagement members that releasably engage the plugs. The plugs are engaged by their associated engagement members, positioned where desired, concrete is poured therearound, and the plugs are released by the plug engagement members so that said plugs are thereby built into the concrete floor poured therearound and so that the frame may be used to position four additional plugs in the next Bye chair location.

Although the invention is depicted in connection with a chair, it should be understood that the novel structure has application in any context where a mount area is required to remain flush to the surrounding environment. The claims that follow cover the novel structure and as such, all applications of the structure, whether specifically listed herein or not, as a matter of law.

The primary object of this invention is to provide an efficient means whereby theater operators can quickly remove and install theater chairs as needed to meet the needs of their wheelchair-using patrons and their more able-bodied patrons as well.

Another important object is to attain the above object with a chair design that prevents chair removal by unauthorized persons.

A more general object is to provide means for securely mounting any item that may require removal at some time, and to provide such means in a way that will foil unauthorized persons in their attempts to accomplish an unauthorized removal of the removably mounted object.

These and many other important objects, features, and advantages of the invention will become apparent as this description proceeds.

The invention accordingly comprises the features of construction, combination of elements and arrangement of parts that will be set forth in the construction hereinafter described, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENTS

Figure 1:
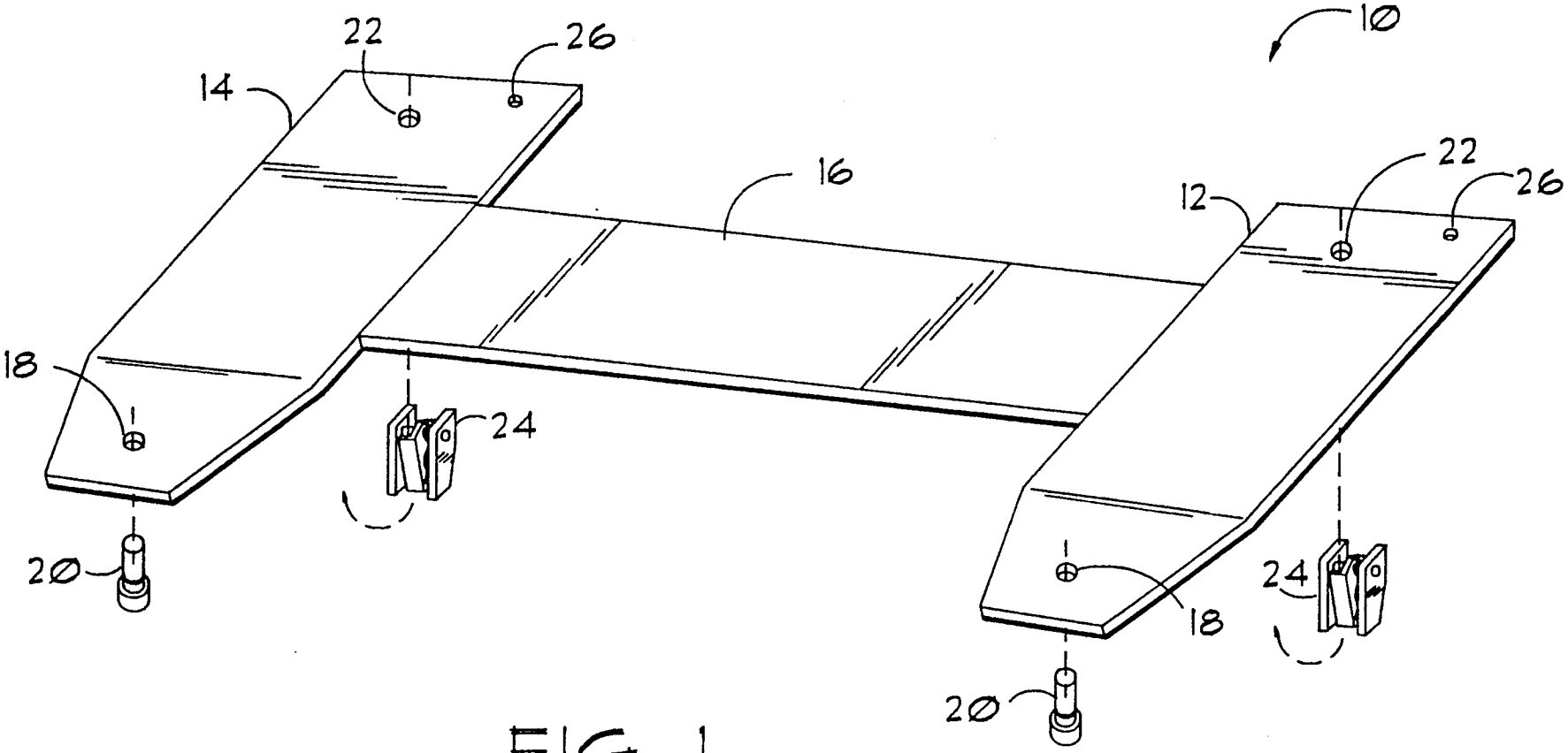
FIG. 1 is an exploded perspective view of the base plate, the forward foot pins, and the rearward rotation block assemblies.

Referring now to FIG. 1, it will there be seen that the novel base plate is denoted as a whole by the reference numeral 10. It should be understood from the outset that the chair or other removably mounted apparatus is permanently affixed to the upper surface of said base plate. Flat base plate 10 has a longitudinally disposed left foot member 12 and a longitudinally disposed right foot member 14 disposed parallel thereto. Transversely disposed flat plate 16 interconnects said left and right foot members. A hole 18, 18 is formed in the leading end of each foot member to provide a means for mounting a forward plug-engaging means in the form of forward foot pin 20, 20 therein. The position of each foot pin when the base plate is assembled is best understood in connection with FIG. 5 or 6; each hole 18, 18 is closed by its associated foot pin as shown in those FIGS. A similar hole 22, 22 is formed in the trailing end of each foot member, and a rearward plug-engaging means in the form of rotation block assembly 24, 24 is mounted to the underside of plate 10 in alignment with said holes, but said holes are not closed thereby. These holes 22, 22 admit the unlatching part of the novel tool so that the rotation pin of each rotation block 24 can be unlocked from its associated catch member. Holes 26, 26, are used when the chair has been released from its locked down position, as will be explained in connection with FIG. 13 hereinbelow.

Figure 2:
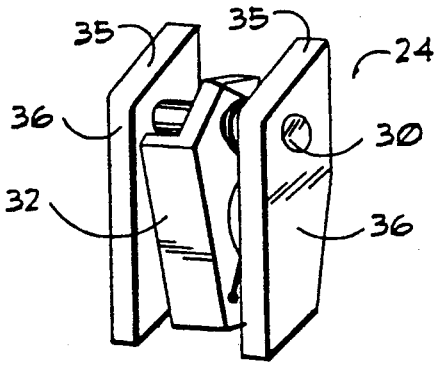
FIG. 2 is a partially exploded perspective view of a rotation block assembly.
Figure 3:
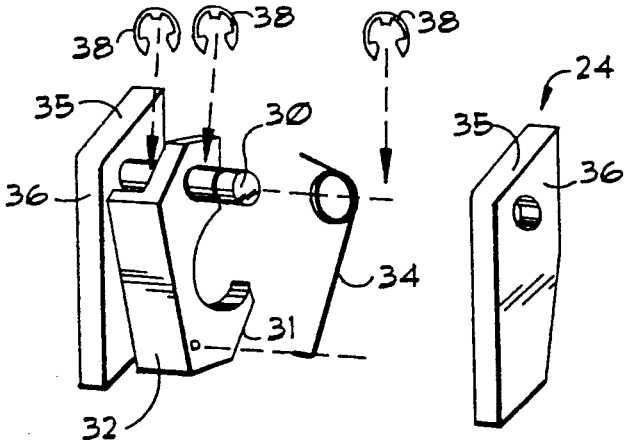
FIG. 3 is a fully exploded view of a rotation block assembly.
Figure 4:
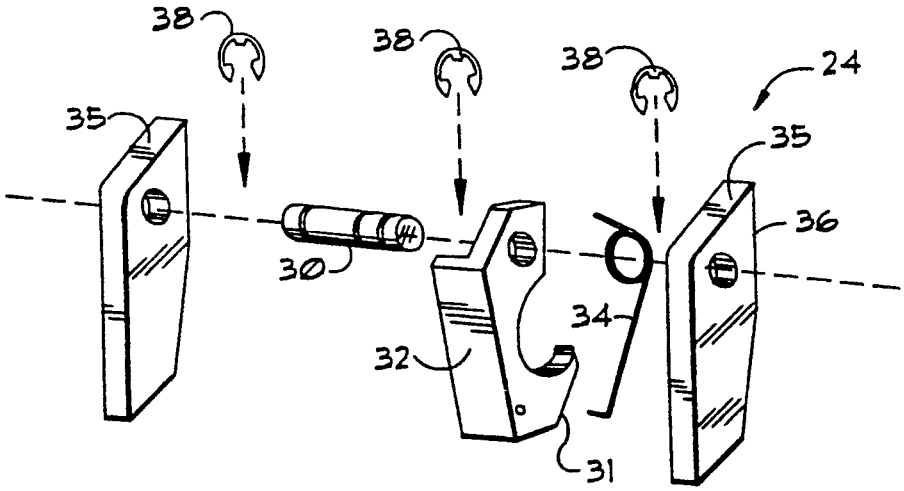
FIG. 4 is a perspective view of an assembled rotation block assembly.

The structure of a rotation block assembly 24, 24 is shown in more detail in FIGS. 2–4. Each assembly 24 includes a pivot pin 30 upon which is rotatably mounted a rotation pin 32. Biasmeans 34 biases rotation pin 32 into its latching relation to the strike bar in its associated rearward plug, as will be shown hereinafter, and the flat tops 35, 35 of end walls 36, 36 are secured to the underside of base plate 10 to fixedly position each assembly 24 just below its associated hole 22. Clips 38 prevent transverse movement of rotation pin 32 relative to pivot pin 30.

Figure 5:
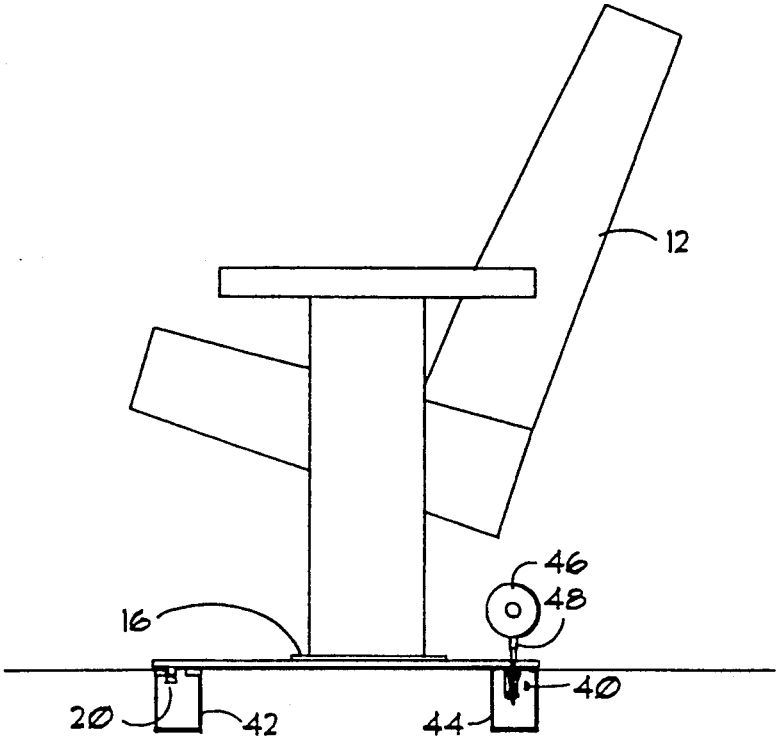
FIG. 5 is a side elevational view showing the novel tool in use to unlock a chair from its mount.
Figure 6:
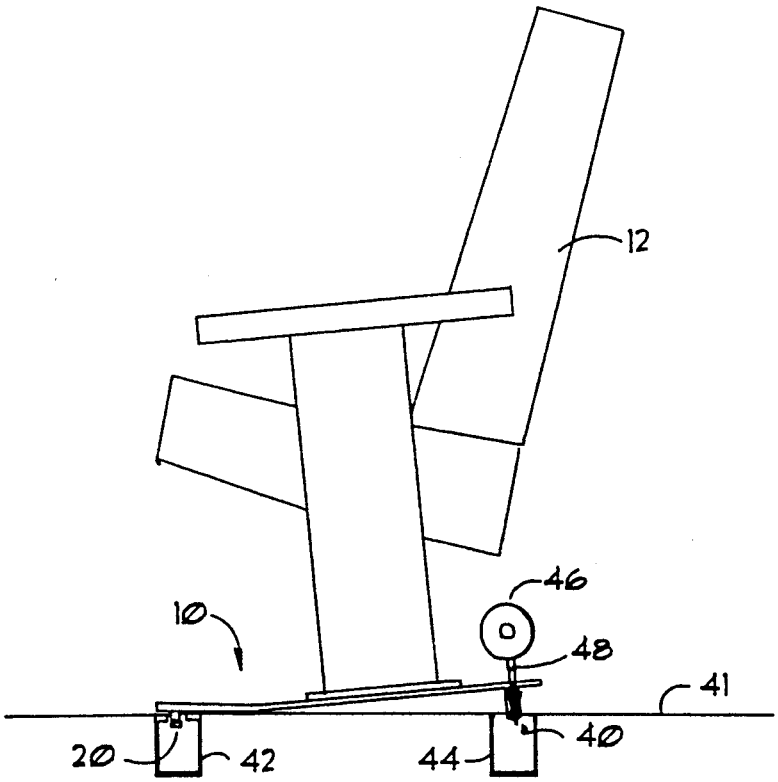
FIG. 6 is a side elevational view showing the chair of FIG. 5 tilted forwardly so that the rear part of the base plate is separated from the rear floor plugs.
Figure 7:
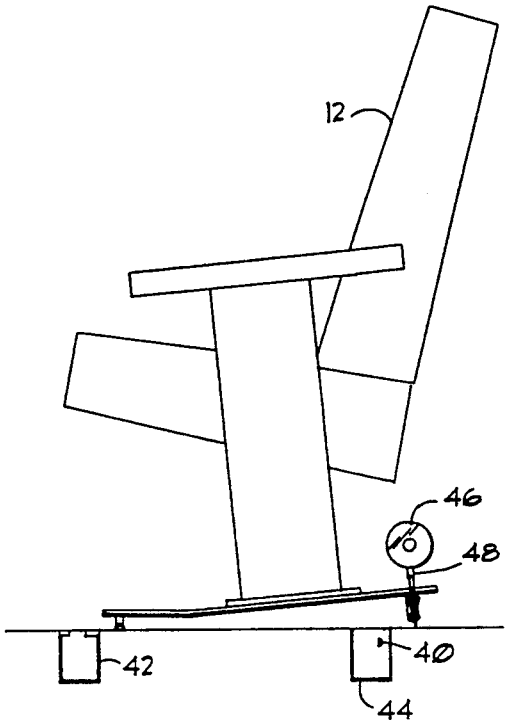
FIG. 7 is a side elevational view showing how the chair is slid rearwardly to disengage its forward foot pins from the forward plugs.
Figure 18:
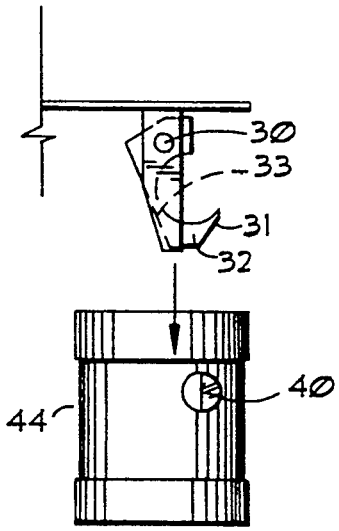
FIG. 18 is a side elevational view showing a rearward rotation block assembly in alignment with its associated rearward floor plug.

Strike bar 40, the forward left floor plug 42, the rearward left floor plug 44, and the left end of the novel tool, including left wheel 46 and left removal pin 48, are shown in FIGS. 5 and 6. In FIG. 5, rotation pin 32 of the rotation block assembly is shown driven from latching engagement with said strike bar by said removal pin. In FIG. 6, the theater employee is tilting the chair forwardly to lift the trailing end of base plate 10 from the floor 41. When each rotation block assembly 24 has been removed from its associated floor plug, as shown in said FIG. 6, the chair may be slid rearwardly so that the forward foot pins 20, 20 may be disengaged from their respective floor plugs 42, 42 as should be clear from a comparison of FIGS. 5 and 6. After the chair has been completely freed as depicted in FIG. 7, the removal tool is inverted and placed in the position shown in FIG. 8 so that the rearward end of base plate 10 is now supported by wheels 46, 46 of the novel removal tool. As shown in FIG. 9, the chair is then tilted back so that it is balanced on said wheels, and the employee uses the back of the chair to cart it away. The same configuration of parts is used to return the chair to its regular position as well, but the removal tool is not needed to reengage the rotation pin 32 and strike bar 40 because beveled surface 31 of rotation pin 32 (see FIGS. 2 and 3) slides past strike bar 40 when each rotation block assembly 24 is lowered into its associated rear plug 44 as shown in FIGS. 10 and 18. A vending machine or similar large object could be handled in the same manner as the chair.

Figure 10:
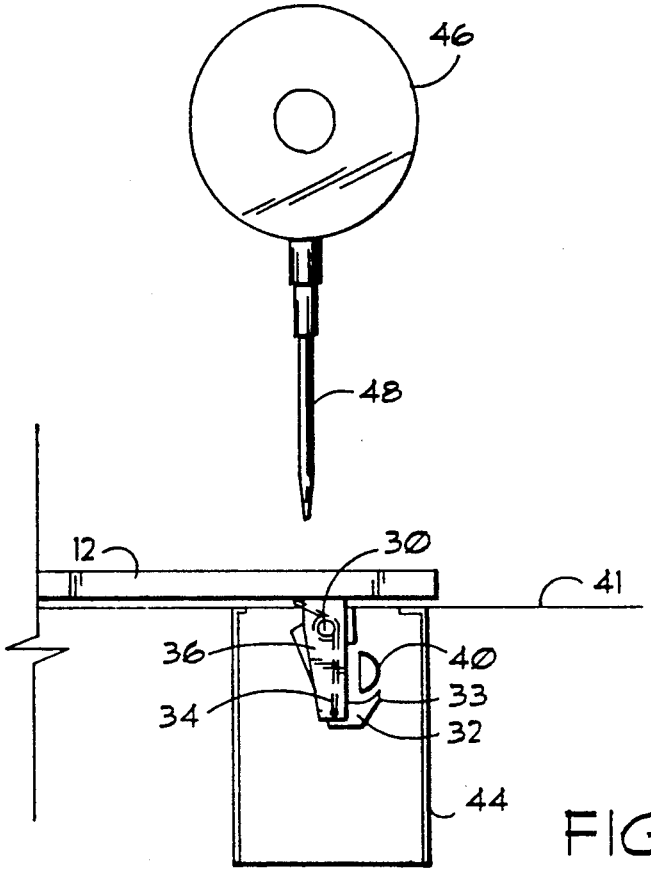
FIG. 10 is a side elevational view of a rotation pin in repose and a side elevational view of the tool for driving it out of said position of repose.
Figure 11:
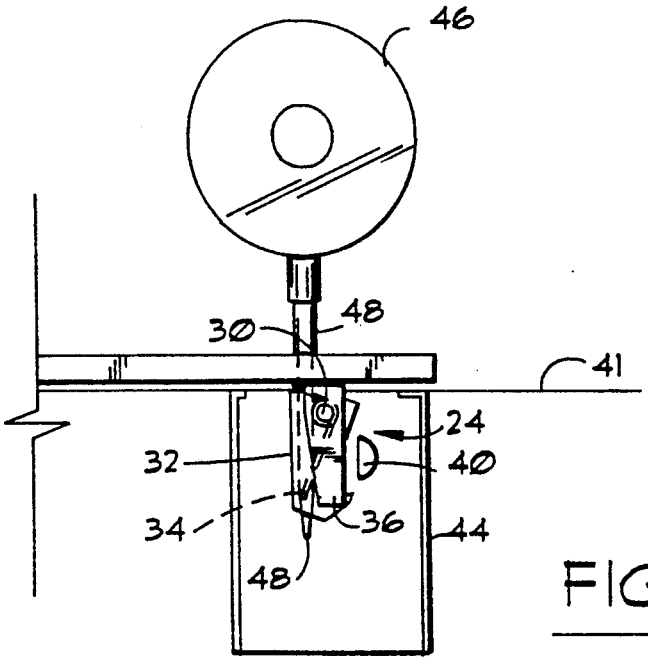
FIG. 11 is a side elevational view of the rotation pin driven out of its position of repose by the novel tool.
Figure 14:
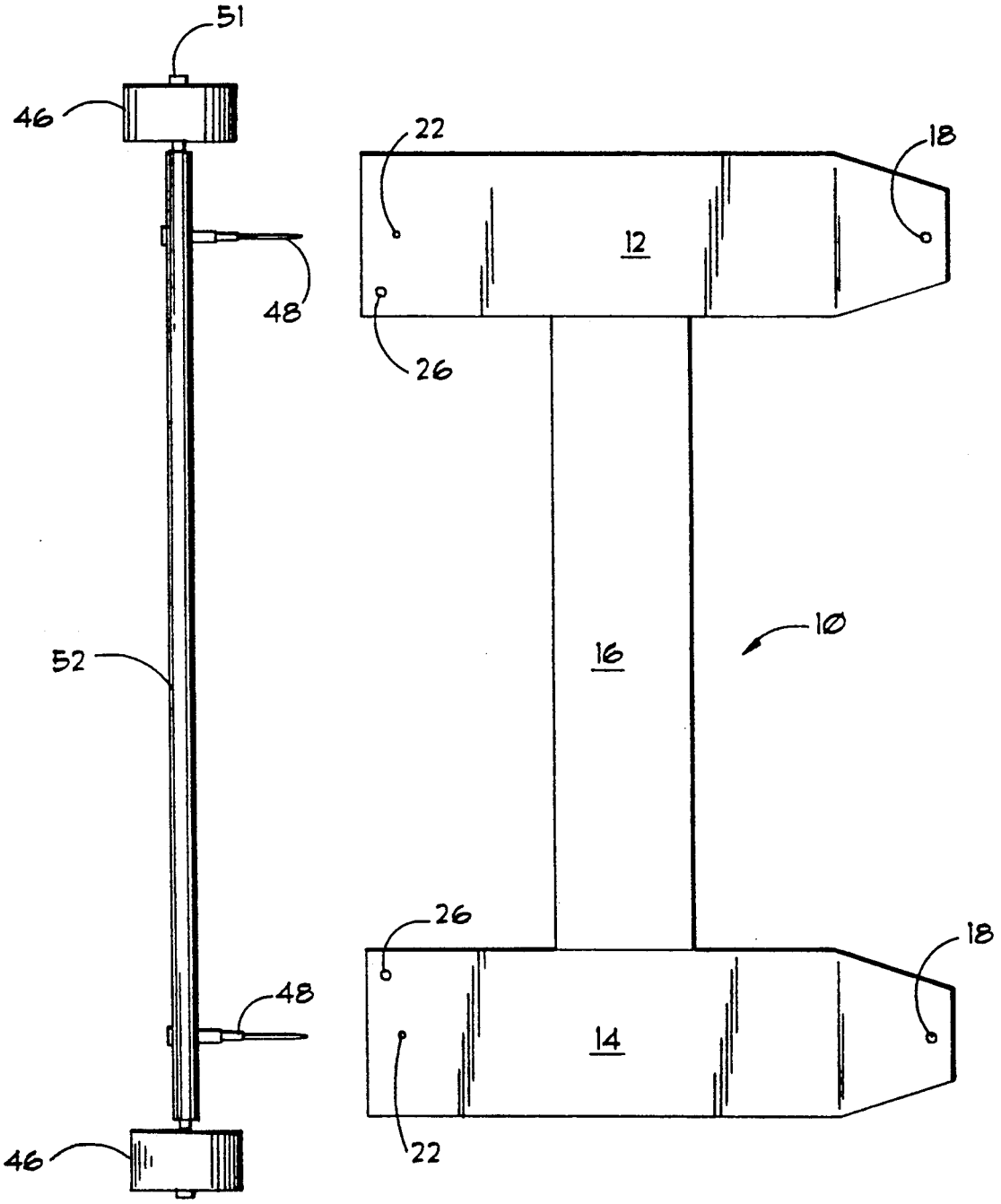
FIG. 14 is a top plan view of the base plate and the removal tool.

The operation of the removal tool is better understood in connection with FIGS. 10 and 11. FIG. 10 shows rotation pin 32 in repose under the bias provided by bias means 34 so that its rearwardly extending hooked part is positioned below the strike bar 40. In a commercial embodiment, said hooked part actually engages said strike bar and is not spaced therefrom as shown. Thus, the chair cannot be lifted from its mount. To drive rotation pin 32 and its hooked part out of engagement with strike bar 40, each removal pin 48, of which there are two as shown in FIG. 14, is aligned with its associated hole 22 and inserted therethrough as depicted in FIG. 11. Pin 48 slidingly strikes rearwardly sloped surface 33 of rotation pin 32 (see FIG. 18 for a view of said surface 33), and the bias of bias means 34 is thereby overcome so that the rotation pin 32 is driven into the position shown in FIG. 11. Note that the hooked part of rotation pin 32 no longer engages strike bar 40; this frees the rearward end of base plate 10 as aforesaid. When the chair is tilted forwardly as shown in FIG. 6, the entire rotation block assembly 24 is lifted out of rear floor plug 44 because said assembly is secured to the underside of base plate 10 as mentioned earlier. Each removal pin 48 is sandwiched between sloped surface 33 of its associated rotation pin 32 and pin 30.

Figure 8:
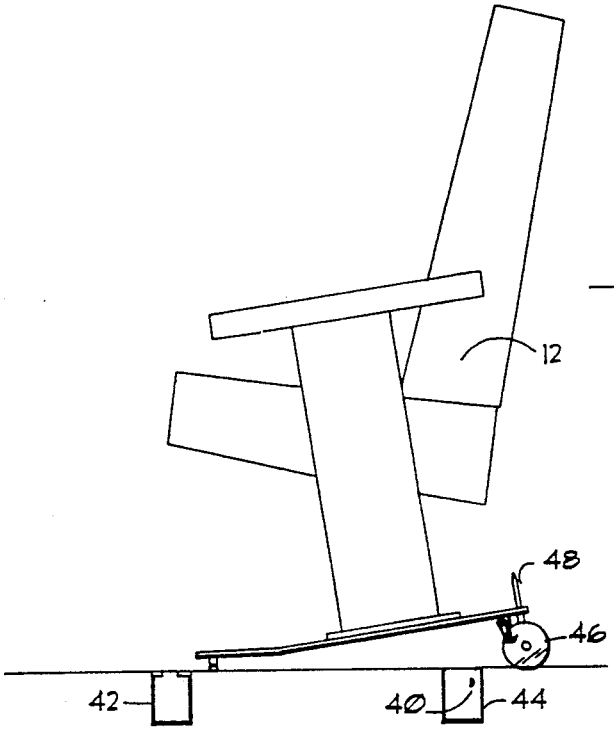
FIG. 8 is a side elevational view showing the removal tool inverted to serve as the means for transporting the detached chair.
Figure 9:
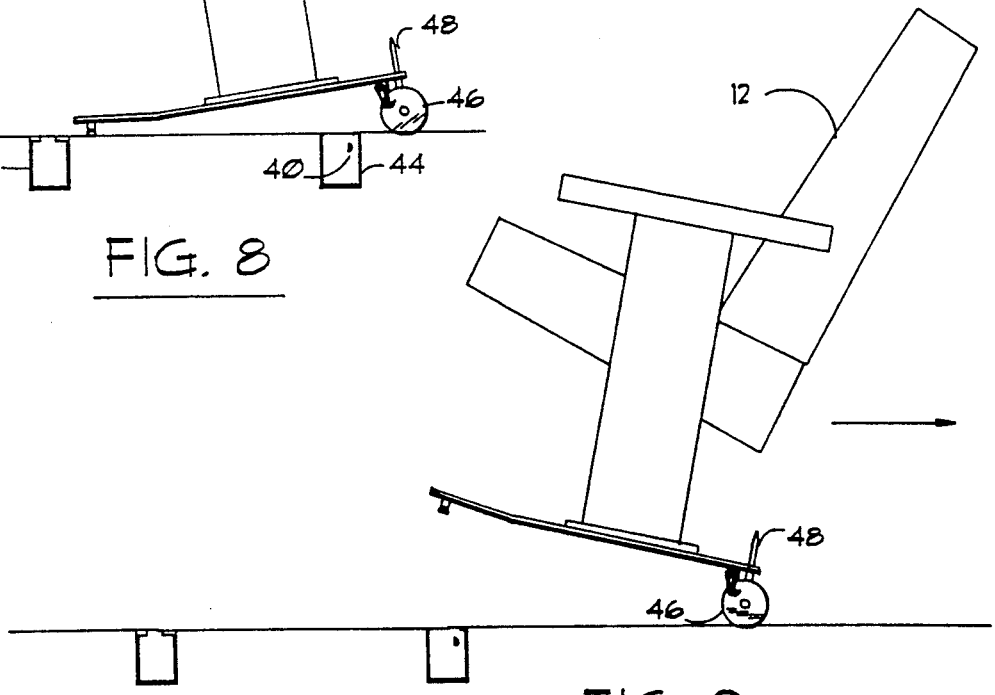
FIG. 9 is a side elevational view showing the chair tilted rearwardly so that its back may be used as a handle means during transportation of said chair.
Figure 12:
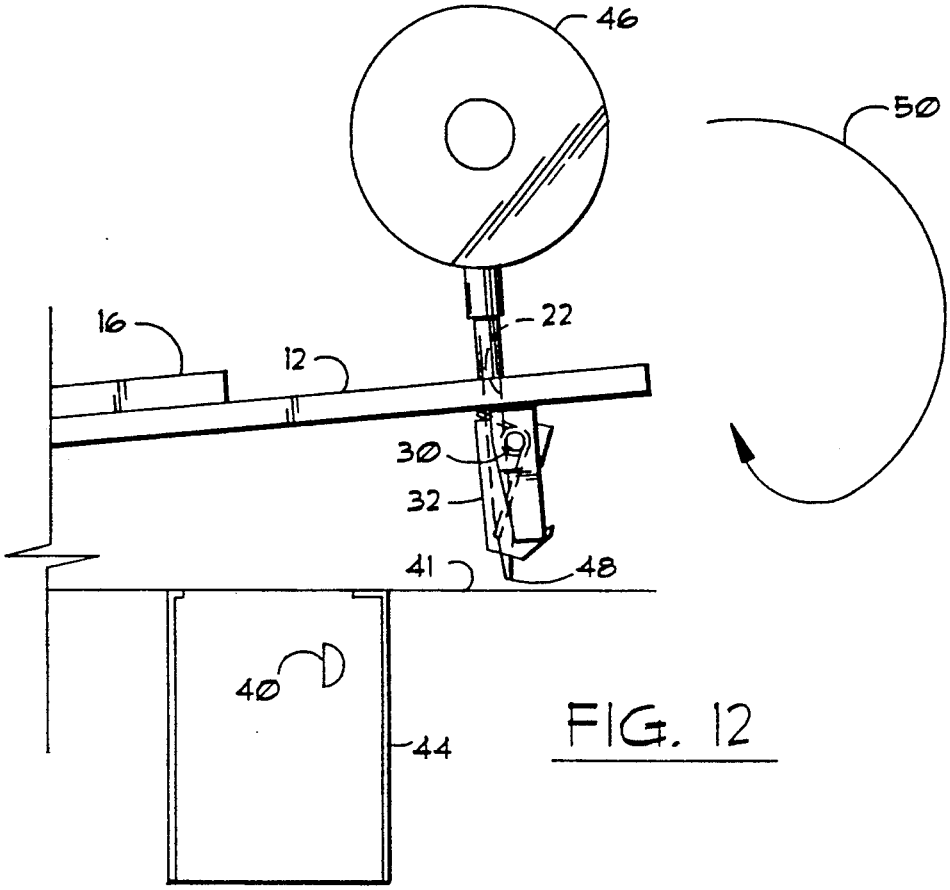
FIG. 12 is an enlarged side elevational view of the parts shown in the lower right hand corner of FIG. 7.
Figure 13:
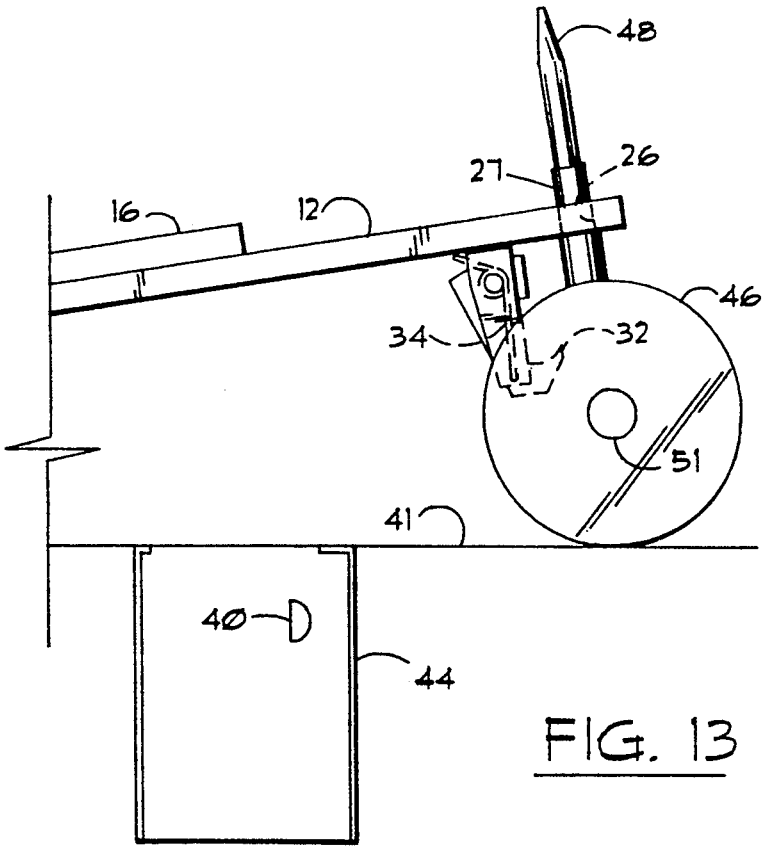
FIG. 13 is an enlarged side elevational view of the parts shown in the lower right hand corner of FIG. 8.

As indicated in FIG. 12 by directional arrow 50, the removal 12 tool is then inverted, i.e., placed into its FIG. 13 position (and as also shown in FIGS. 8 and 9). Note in FIG. 12 that each removal pin 48 extends through its associated hole 22, as mentioned earlier in connection with FIG. 1, when each rotation pin is unlatched from its associated strike bar, but that removal pins 48 are inserted through holes 26, 26 when the tool is inverted. A boss means 27 may also be provided to increase the structural integrity of the assembly as depicted in FIG. 13.

A plan view of the novel tool is provided in FIG. 14. Axle 51 interconnects wheels 46 and removal pins 48 are mounted to nonrotatable sleeve 52 that ensleeves said axle. All of the elements of base plate 10 shown in FIG. 14 have already been pointed out.

Figure 15:
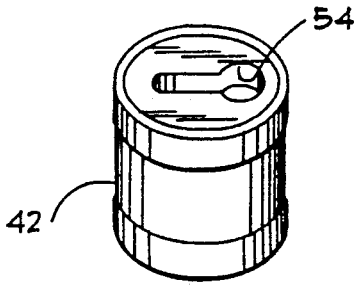
FIG. 15 is a perspective view of a forward floor plug.
Figure 16:
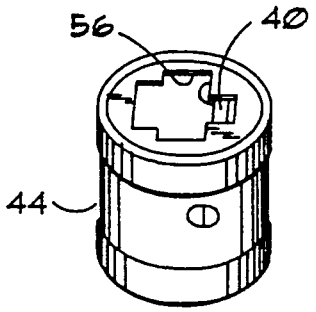
FIG. 16 is a perspective view of a rearward floor plug.
Figure 17:
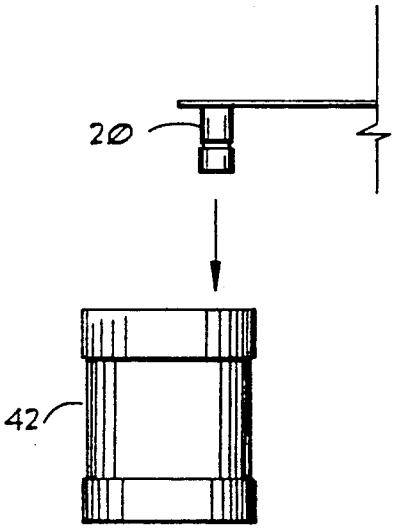
FIG. 17 is a side elevational view showing a forward foot pin in alignment with its associated forward floor plug.

A forward floor plug 42 is shown in perspective in FIG. 15. Keyway 54 formed therein receives forward foot pin 18 as mentioned earlier, and as indicated in the side elevational view of FIG. 17, when the chair is installed. A rearward floor plug 44 is shown in perspective in FIG. 16; cruciform opening 56 formed therein admits rotation block assembly 24 so that rotation pin 32 can engage strike bar 40, as indicated in the side elevational view of FIG. 18.

Figure 19A:
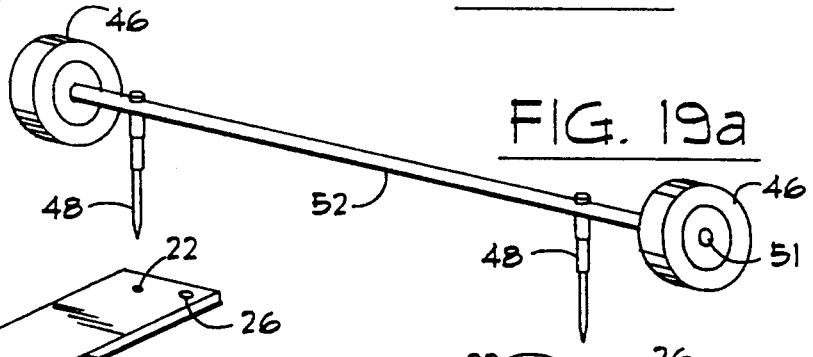
FIG. 19 is a perspective view of the base plate and removal tool.
Figure 19:
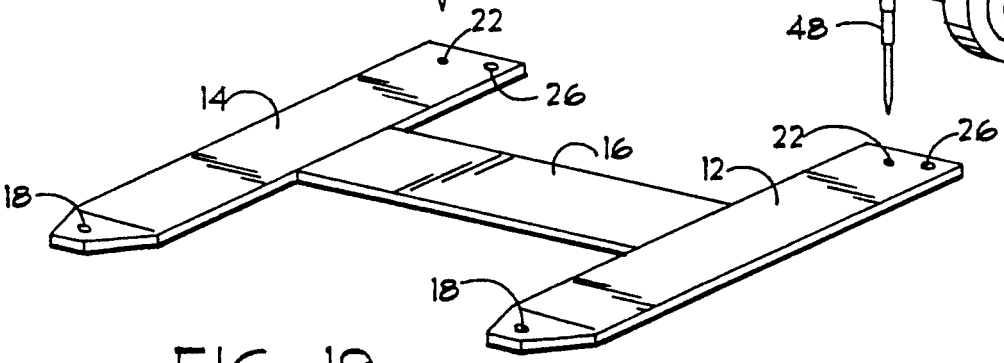

FIG. 19 is a perspective view showing how removal pins 48 are oriented in a vertical plane prior to insertion into openings 22 to disengage each rotation pin 32 from its associated strike bar 40.

Figure 20:
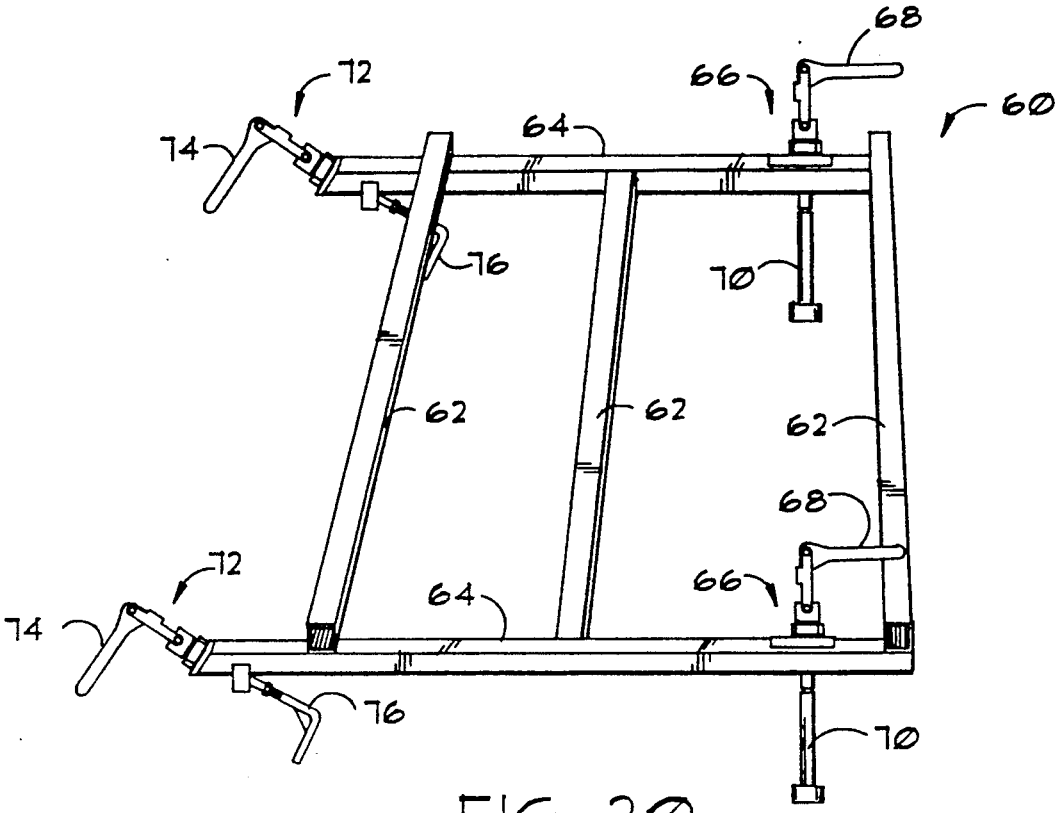
FIG. 20 is a perspective view of the novel assembly for holding the plugs when a new floor is being poured in an assembly hall.
Figure 21:
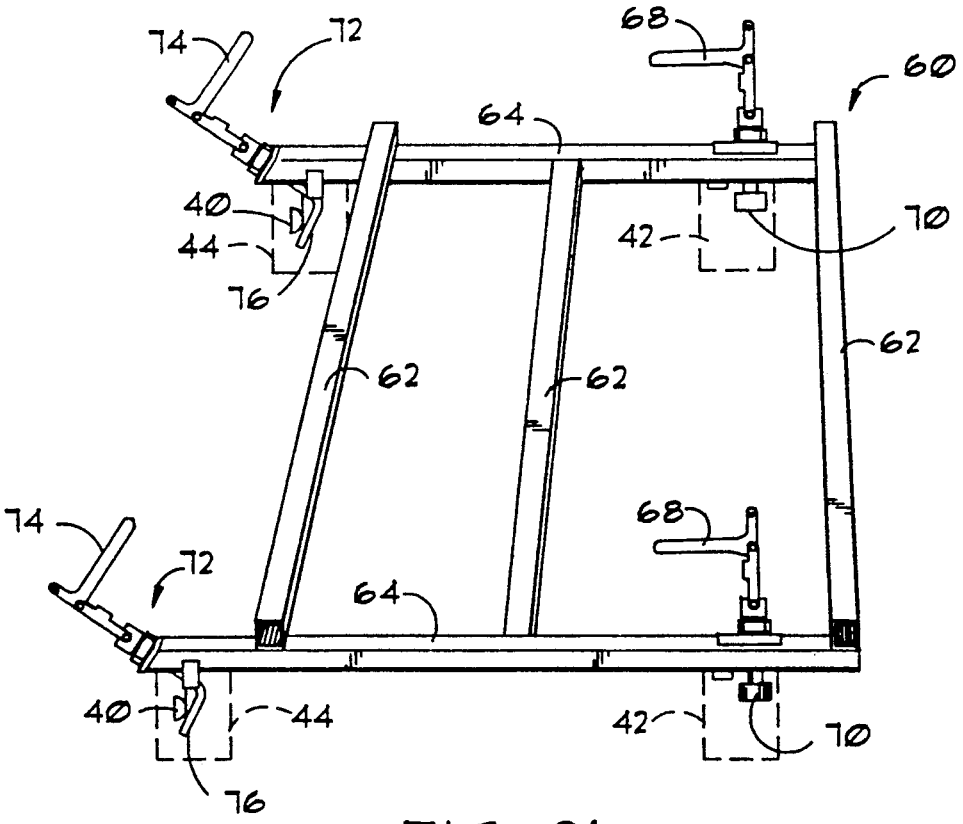
FIG. 21 is a perspective view of the assembly shown in FIG. 20 in its plug-holding configuration.

FIGS. 20 and 21 provide perspective views of a tool employed when the novel floor plugs 42, 44 are being permanently installed in an assembly hall under construction. Tool 60 includes a frame having plural transverse rigid frame members, collectively denoted 62, and a pair of longitudinal rigid frame members 64. Each forward clamp member 66 is fixedly secured to its associated longitudinal frame member 64 and includes a handle 68 that is pivotally mounted for movement between an unlocked position as shown in FIG. 20 and a looked position as shown in FIG. 21. When the clamp is unlocked, linkage member 70 is extended (FIG. 20) and when it is looked, said linkage member is retracted (FIG. 21). Forward floor plugs 42 are positioned on their associated linkage member 70 when the linkage member is extended; pivoting of the clamp handle 68 then locks the plug against the bottom of frame 60 as indicated in FIG. 21. A similar clamp 72 engages each rearward floor plug 44; each clamp 72 includes pivotally mounted handle 74 and linkage member 76 that extends and retracts in response to throwing of said handle 72 in the same manner as clamp 66. Each clamp 72 is fixedly secured to its associated longitudinal member 64 at an angle as depicted to enable facile insertion of extension member 76 into cruciform opening 56 of rearward floor plug 44. Specifically, such angular insertion is required to enable hooked extension member 76 to get past strike bar 40 as understood in connection with FIG. 21. When each floor plug has been inserted onto its associated extension member and each clamp handle has been thrown, all four of said floor plugs are firmly held in a predetermined fixed position by frame 60. Said frame is positioned where a Bye chair will be, and concrete is poured up to the bottom surface of longitudinal frame members 64, thereby covering all parts of the floor plugs except their respective top surfaces. After the concrete has dried, the clamp handles are thrown to release each plug from the frame, and the frame is lifted away, leaving the floor plugs in position and ready to be used in the manner described herein.

This invention is clearly new and useful. Moreover, it was not obvious to those of ordinary skill in this art at the time it was made, in view of the prior art when considered as a whole in accordance with the requirements of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that might be said, as a matter of language, to fall therebetween.

Now that the invention has been described,

What is claimed is:

1. A removably mounted apparatus, comprising:

a flat base plate having a top surface upon which is permanently mounted said apparatus;

a plurality of plug engaging members secured to said base plate in depending relation thereto;

a plurality of plug members embedded within a floor that supports said apparatus;

each of said plug engaging members being adapted to releasably engage its associated plug;

a tool for disengaging a preselected pair of said plug engaging members from their associated plugs;

a first pair of access holes formed in said base plate;

said tool adapted to extend through said first pair of access holes to disengage said plug engaging member from their associated plugs; and said tool begin an independent item that is storable in a location remote from said removably mounted apparatus so that it is available for use only to authorized personnel;

whereby unauthorized personnel may not disengage said plug engaging members from their associated plugs in the absence of said tool.

2. The apparatus of claim 1, wherein said plurality of plug engaging members includes a pair of laterally spaced forward foot pins and a pair of laterally spaced rearward rotation block assemblies, said forward foot pins being slideably engageable with their associated plugs and said rearward rotation block assemblies being biased into engagement with their associated plugs.

3. The apparatus of claim 1, wherein the plugs associated with said rearward rotation block assemblies include a stationary strike bar member therewithin, and wherein each of said rearward rotation block assemblies includes a pivotally mounted, biased rotation pin that engages its associated strike bar member when said bias means is in repose.

4. The apparatus of claim 1, wherein said tool further includes means for overcoming said bias means so that said rearward rotation block assemblies may be released from their associated plugs.

5. The apparatus of claim 1, wherein said tool includes a pair of laterally spaced apart, rotatably mounted wheel members, an axle means for interconnecting said wheel members, a nonrotatable sleeve member for ensleeving said axle means, and a pair of laterally spaced apart removal pins mounted to opposite ends of said sleeve member in parallel relation to one another.

6. The apparatus of claim 1, wherein said first pair of access holes is formed in said base plate to admit said removal pins therethrough, said removal pins overcoming said bias means to disengage each of said rearward rotation block assemblies from its associated floor plug, and further comprising a second pair of holes formed in said base plate for receiving said removal pins when said tool is inverted so that said tool serves as a dolly for carting said apparatus after said plug engaging members have been disengaged from said plugs.

7. A removably mounted apparatus, comprising:

a plurality of floor plugs, each of which is embedded in a floor, said plurality of floor plugs being collectively disposed in a generally square pattern;

said plurality of floor plugs including a pair of laterally spaced apart forward floor plugs and a pair of laterally spaced apart rearward floor plugs;

a flat base plate including a left foot member and aright foot member interconnected by an interconnecting plate;

said apparatus being permanently mounted to a top surface of said base plate;

a forward foot pin disposed in depending relation to a forward end of each of said left and right foot members;

a rearward rotation block assembly disposed in depending relation to a rearward end of each of said left and right foot members;

each of said forward floor plugs adapted to releasably engage its associated forward foot pin;

each of said rearward floor plugs adapted to releasably engage its associated rearward rotation block assembly;

bias means associated with each of said rotation block assemblies for urging each rotation block assembly to engage its associated rearward floor plug;

a tool for overcoming the bias of said bias means so that each rotation block assembly may be detached from its associated rearward floor plug;

an access opening formed in each of said left and right foot members in registration with each of said rotation block assemblies;

said tool adapted to extend through each of said access openings;

said bias means being overcome only when accessed through its associated access opening by said tool.

8. The apparatus of claim 7, wherein said tool includes a pair of laterally spaced apart removal pins mounted to an axle assembly, in laterally spaced relation to one another, and wherein said spacing between said removal pins is equal to the spacing between said access holes.

9. The apparatus of claim 8, further comprising a pair of wheel members, each of said wheel members being rotatably mounted to opposite ends of said axle assembly.

10. The apparatus of claim 9, further comprising a pair of laterally spaced apart wheel mounting openings formed in a rearward part of each of said left and right foot members so that said tool, after being used to overcome said bias means to thereby allow separation of said base plate from said floor plug members, may be inverted and said removal pins inserted through said wheel mounting openings so that said wheels rollingly engage the support surface within which said plurality of floor plugs is embedded, whereby said apparatus may be wheeled away upon said wheel members.

11. The apparatus of claim 10, wherein each of said rotation block assemblies includes a pivot pin, a rotation pin mounted pivotally with respect to said pivot pin, a strike bar fixedly secured within each of said rearward floor plugs, each of said rotation pins being hooked to engage its associated strike bar, and said bias means urging its associated rotation pin into locking engagement with its associated strike bar.

12. The apparatus of claim 11, wherein each rotation pin has a beveled surface that slides past its associated strike bar when each rotation block assembly is inserted into its associated rearward floor plug so that said apparatus is reattached without the use of said tool.

13. The apparatus of claim 12, further comprising a frame member having four clamps mounted thereon in cooperative relation to each of said four floor plugs, each of said clamps releasably engaging an associated floor plug when a handle thereof is in a first position, an each of said clamps releasing its associated floor plug when said handles are in a second position whereby all four plugs may be engaged by said clamps, inserted into position with respect to a floor, and released upon placing said handles in their respective second positions.

14. A removably mounted chair, comprising:

a flat base plate having an upper surface to which said chair is permanently affixed;

a plurality of four plugs embedded in a floor in a generally square pattern;

a plurality of four plug-engaging members depending from an underside of said base plate;

said plurality of plug-engaging members including a pair of forward foot pins that slidingly engage their associated plugs and a pair of rearward rotation block assemblies that latchingly engage their associated plugs;

a tool for unlatching said rearward rotation block assemblies so that said forward foot pins may be slidingly disengaged form their associated plugs after said rearward rotation block assemblied have been disengaged by said tool;

said tool including wheels so that it serves as a dolly for carting away said chair after said chair has been released.

15. The chair of claim 1, wherein said tool further includes an axle for interconnecting said wheels, a non-rotatable sleeve that ensleeves said axle, and a pair of laterally spaced apart removal pins mounted on said sleeve, said removal pins begin operative to disengage said rotation block assemblies from their associated plugs.

16. The chair of claim 15, further comprising a first set of openings formed in said base plate, said first said of openings being access openings through which said removal pins are inserted to disengage said rotation block assemblies from their associated plugs.

17. The chair of claim 16, further comprising a second set of openings formed in said base plate, said second set of openings receiving said removal pins when said tool is inverted after said rotation block assemblies have been disengaged from their associated plugs.

18. The chair of claim 17, further comprising a fixedly positioned strike bar disposed in each of said rearward plugs, and wherein each of said rotation block assemblies includes a pivotally mounted, biased rotation pin that releasably engages its associated strike bar when said rotation block assemblies are positioned within their associated plugs and when each of said bias means is in repose.

* * * * *